US009384915B2

(12) United States Patent
Cecchetti et al.

(10) Patent No.: US 9,384,915 B2
(45) Date of Patent: Jul. 5, 2016

(54) ELECTRONIC SWITCH ASSEMBLY

(75) Inventors: Christian Cecchetti, Istrana (IT); Stefan Hackenbuchner, Treviso (IT); Pierpaolo Marcon, Treviso (IT); Giancarlo Pellizzari, Resana (IT)

(73) Assignee: OSRAM GmbH, Munich (DE)

( * ) Notice: Subject to any disclaimer, the term of this patent is extended or adjusted under 35 U.S.C. 154(b) by 435 days.

(21) Appl. No.: 14/124,750

(22) PCT Filed: Jun. 6, 2012

(86) PCT No.: PCT/IB2012/052838

§ 371 (c)(1),
(2), (4) Date: Dec. 9, 2013

(87) PCT Pub. No.: WO2012/168868

PCT Pub. Date: Dec. 13, 2012

(65) Prior Publication Data

US 2014/0111024 A1 Apr. 24, 2014

(30) Foreign Application Priority Data

Jun. 10, 2011 (IT) ..... TO2011A0513

(51) Int. Cl.

| | |
|---|---|
| ***B23K 11/24*** | (2006.01) |
| ***H02B 1/24*** | (2006.01) |
| H01H 9/54 | (2006.01) |
| ***H01H 89/00*** | (2006.01) |
| ***H05B 37/02*** | (2006.01) |

(52) U.S. Cl.

CPC ..... *H01H 9/54* (2013.01); *H01H 89/00* (2013.01); *H05B 37/0209* (2013.01); *Y10T 307/74* (2015.04)

(58) Field of Classification Search

CPC ..... H01H 9/54; H01H 89/00; Y10T 307/74; Y10T 307/944

USPC ..... 307/112, 140

See application file for complete search history.

(56) References Cited

U.S. PATENT DOCUMENTS

2007/0171625 A1 7/2007 Glazner
2009/0103228 A1 * 4/2009 Elderbaum ..... H01H 9/167 361/187

(Continued)

FOREIGN PATENT DOCUMENTS

| | | | |
|---|---|---|---|
| CN | 2699345 | Y | 5/2005 |
| CN | 101842983 | A | 9/2010 |
| WO | 2009051982 | A2 | 4/2009 |

OTHER PUBLICATIONS

International Search Report of PCT/IB2012/052838 dated Sep. 19, 20112.

(Continued)

*Primary Examiner* — Carlos Amaya
(74) *Attorney, Agent, or Firm* — Viering, Jentschura & Partner mbB

(57) ABSTRACT

A switch assembly, for instance adapted to wall-side installations, for supply arrangements of a load via multiple activation points (for example in the form of "double switching"), comprises a pair of traveler contacts alternatively connectable to a power supply, as well as a switch having an output contact, alternatively connectable to one or the other of the traveler contacts, respectively, on the basis of the current position of switch. Switch is an electronic switch which is connected, for example through an electronic circuit which optionally also performs a driving function on switch, to a respective power line. Powering elements are provided, for example in the form of a pair of diodes, controlled electronic switches or diode bridges, which connect said respective power line to the one of traveler contacts which is currently connected to power supply, therefore ensuring a steady supply irrespective of the switch position.

9 Claims, 2 Drawing Sheets

(56) References Cited

U.S. PATENT DOCUMENTS

| | | | |
|---|---|---|---|
| 2010/0288609 | A1 | 11/2010 | Strothmann |
| 2011/0141647 | A1 | 6/2011 | Garcia et al. |

OTHER PUBLICATIONS

Chinese Office Action based on Application No. 201280028351.2(7 Pages) dated May 6, 2015 (Reference Purpose Only).

* cited by examiner

ELECTRONIC SWITCH ASSEMBLY

RELATED APPLICATIONS

This application is a national stage entry according to 35 U.S.C. §371 of PCT application No.: PCT/IB2012/052838 filed on Jun. 6, 2012, which claims priority from Italian application No.: TO2011A000513 filed on Jun. 10, 2011.

TECHNICAL FIELD

Various embodiments relate to switch assemblies. Various embodiments may refer to wall-type electronic switch assemblies.

BACKGROUND

FIG. 1 shows a circuit diagram adapted to be used to supply a load L from a mains supply N (for example a 220V/50 Hz or a 120V/60 Hz supply, respectively according to the European and the American standard), through a so-called "double switching", i.e. via a first and a second switch 10 and 12 adapted to be arranged, for example, in different positions in the same room, at both ends of a corridor, or upstairs and downstairs, so that each switch 10 and 12 can be used to activate and deactivate load L, for example in order to turn a light source on and off.

The aforementioned result can be obtained by providing a first electrical contact 14, adapted to connect one of the poles of supply N (for example the neutral pole) to one end of load L, and by implementing both elements 10 and 12 as switches.

Specifically, the first switch 10 is connected so as to be able to send the other pole 16 (for example the phase pole) of supply N alternatively to one or the other of two "hot" contacts 18, 20. Such contacts are sometimes referred to as "switched lines", and are commonly named "travelers".

The second switch 12 is designed so as to connect load L alternatively to one or the other contact 18 and 20 through a contact 22, opposed to the terminal connected with contact 14.

The operation of the connection arrangement depicted in FIG. 1 (also described in documents such as US-A-2007/0171625 or US-A-2010/0288609) is based on the fact that:

- switch 10 allows to activate or deactivate load L on the basis of whether its movable contact is brought towards or away from the one contact, 18 or 20, which is currently connected, via switch 12, to the contact 22 referred to load L, and
- switch 12 allows to activate or deactivate load L on the basis of whether its movable contact is brought towards or away from the contact, 18 or 20, which is currently connected to line 16 via switch 10.

The chain-dotted line in FIG. 1 shows the possibility for the enclosed elements to form a single element, adapted to be mounted on a wall socket, for example in the form of a so-called embedded module.

Both aforementioned documents show moreover the possibility to associate, to the previously described circuit arrangement, an additional lighting source such as a LED, adapted to perform at least one function between locating the switch assembly in the dark and showing the fact that the load is currently activated or deactivated.

SUMMARY

In current electrical appliances, particularly in domotics, the need and/or the advantage can be felt of replacing a mechanical switch, such as switch 12 in FIG. 1, with an electronic switch (for example a relay), also keeping in mind that to such a switch further electronic circuitry may be associated, e.g. a microcontroller, which are adapted to perform various functions, including if desired the driving of the electronic switch.

Such a switch and the possibly associated electronic circuits require however to be powered, and this would basically involve the addition, to the arrangement shown in FIG. 1, of a further powering contact (a further "stage") adapted to supply the electronic circuit.

Various embodiments allow the replacement of a mechanical switch with an electronic switch (relay) in the circuit arrangement of FIG. 1, without the need to resort to a further contact or "stage".

Various embodiments further allow for such a replacement without jeopardizing the possibility of going on activating and deactivating the load via the mechanical switch.

According to the disclosure, various embodiments provide a switch assembly having the features specifically set forth in the claims that follow.

Various embodiments provide the replacement of a mechanical switch with an electronic switch without the need to add further powering contacts. This is true both for interventions on existing appliances and in case of new appliances.

In various embodiments, it is possible to drive the load even in case of a failure of the electronic part.

In various embodiments, the load can still be activated and deactivated through a mechanical switch.

BRIEF DESCRIPTION OF THE DRAWINGS

In the drawings, like reference characters generally refer to the same parts throughout the different views. The drawings are not necessarily to scale, emphasis instead generally being replaced upon illustrating the principles of the disclosure. In the following description, various embodiments of the disclosure are described with reference to the following drawings, in which.

DETAILED DESCRIPTION

Figure 1:
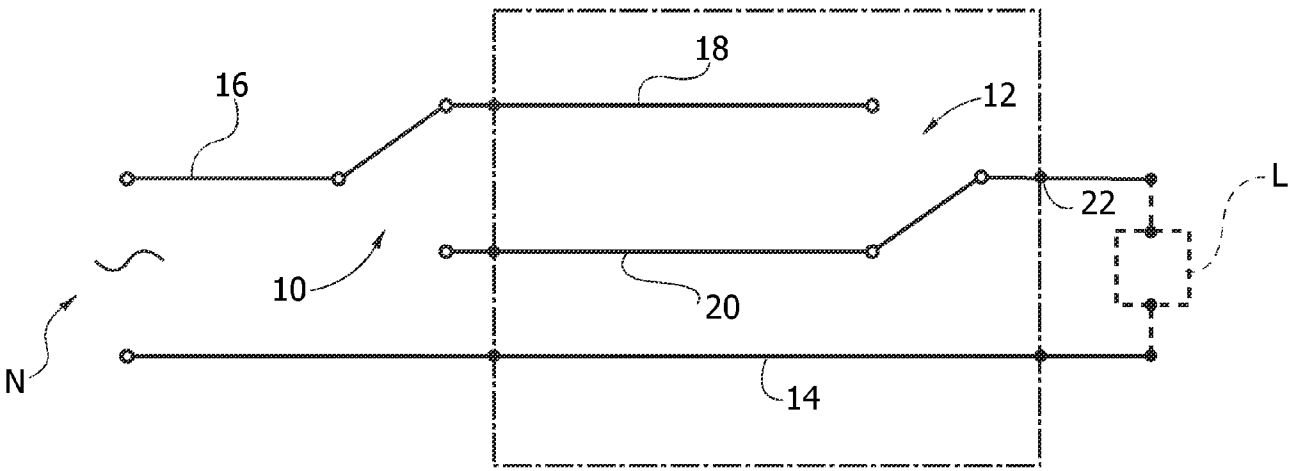
FIG. 1 has already been described in the foregoing.

In the following description, numerous specific details are given to provide a thorough understanding of embodiments. The embodiments can be practiced without one or several specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

Moreover, mutually equivalent elements or components are denoted by the same references in the various Figures. In order not to overburden the present description of embodiments, the description previously set forth with reference to FIG. 1 will not therefore be repeated for FIG. 2.

Broadly speaking, both circuit layouts shown in the Figures are examples of a switch assembly for powering arrangements of a load L, with multiple activation points. For example, load L may be a light source, shown in dashed lines to highlight the fact that load L in itself is part of the switch assembly. Previously mentioned document US-A-2007/0171625 shows the possibility of using an arrangement of this kind in combination with more than two activation points.

Both circuit arrangements shown in the Figures comprise:

- a pair of switched lines or traveler contacts 18, 20, alternatively connectable to input power supply N (through switch 10, which in any case can be implemented as a separate component, not being necessarily included in the same assembly); power supply N can be either an alternate current, according to the previous example, or a direct current; and
- a switch (a mechanical switch, as denoted with 12 in FIG. 1, or an electronic switch, as denoted with 120 in FIG. 2) having an output contact 22 alternatively connectable, according to the position of the respective movable contact, to one or the other of contacts 18 or 20, respectively.

In various embodiments, mechanical switch 12 in FIG. 1 is replaced by a switch or electronic switch 120 (for example a relay of any known kind, i.e. either manually operated or automatically operated, for example through an infrared or wireless remote control).

In this respect it is to be highlighted that various embodiments may completely omit the solution whereby contacts 18, 20 are made alternatively connectable to input power supply N.

Figure 2:
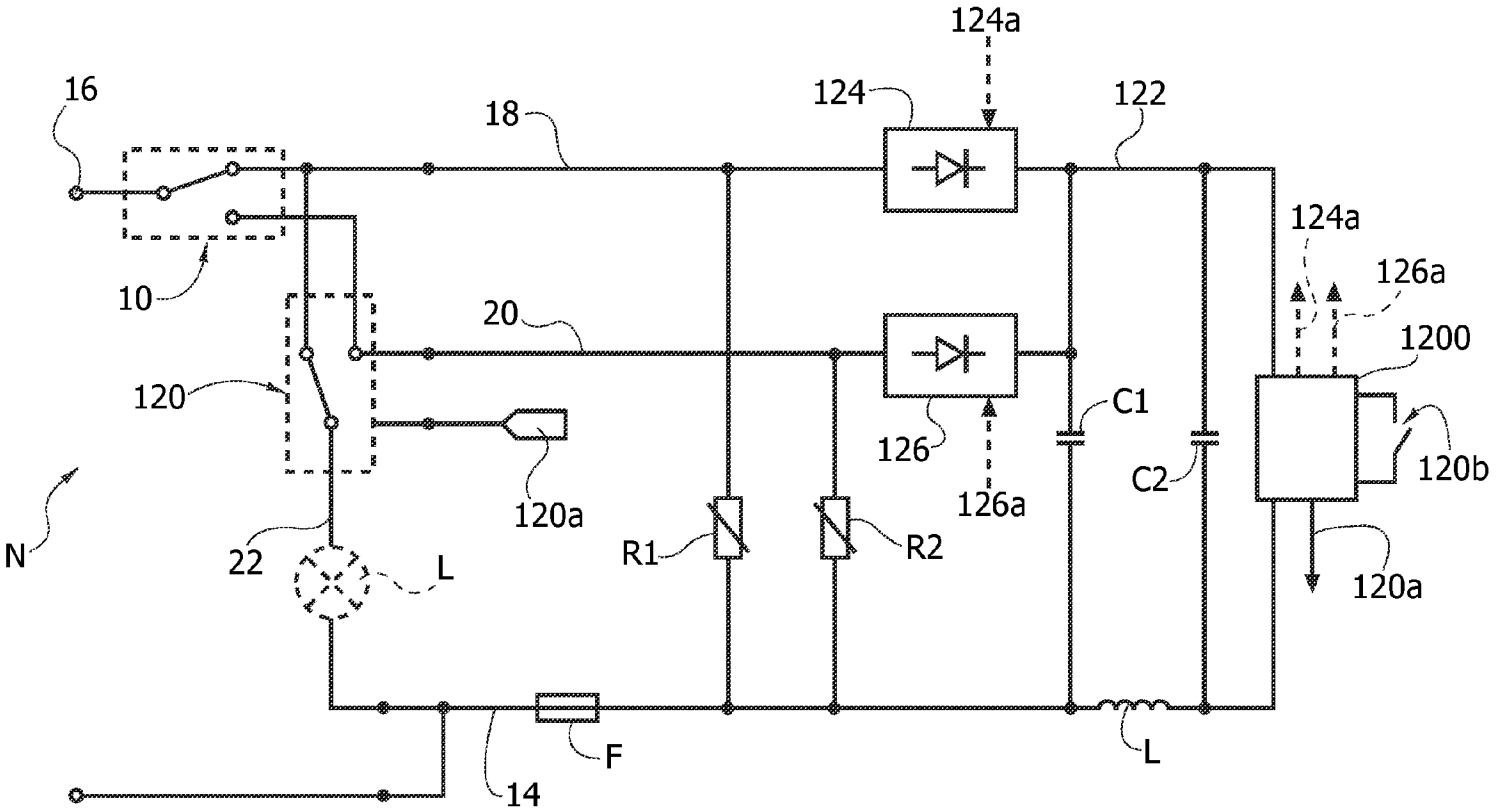
FIG. 2 is a circuit diagram of an embodiment.

Specifically, switch 10 in FIG. 2 can be a separate component, not included in the switch assembly according to the embodiments. For example, switch 10 in FIG. 2 can simply be the same switch as in FIG. 1, i.e. an existing component or module, which has already been installed and which is not replaced, while switch 12 of FIG. 1 is replaced by an electronic switch according to the embodiments.

As for the connection of contact 22 (load) to one or the other of contacts 18 and 20, the electronic switch 120 is adapted to perform the same functions, with the same performance as has already been described with reference to mechanical switch 12.

In various embodiments, to switch 120 further electronic circuitry 1200 may be associated, such as for instance a microcontroller or another device, which is adapted to perform various more or less complex functions, possibly including driving the electronic switch through a line 120*a*.

The exemplary diagram of FIG. 2 shows the possibility to associate to circuit 1200 an operating element 120*b*, which can be used to control, via circuit 1200, the switching of electronic switch 120.

In various embodiments, the control element 120*b* may comprise, for example:

- a mechanical switch,
- a touch switch,
- an infrared or wireless remotely operated element.

In various embodiments, mechanical switch 120*b* can simply be comprised of mechanical switch 12 of FIG. 1 which, though having been replaced by electronic switch 120 for the power supply through load L, is left in place and keeps on being used for controlling the electronic switch assembly, which as been "enriched" with the additional functions offered by circuit 1200.

In various embodiments, in order to ensure the driving function of switch 120 (for example, as in the illustrated case, while ensuring the supply to circuit 1200), the circuit 1200 is connected to a power line 122 connected to two powering elements 124, 126, adapted to be implemented in different ways.

For simplicity of illustration, with the symbols shown in blocks 124 and 126 of FIG. 2 the possibility is expressed of having line 122 connected to the mutually connected cathodes of two diodes, the anodes whereof are respectively connected to one and the other of traveler contacts 18 and 20.

In various embodiments, the circuit 1200 is moreover connected to neutral contact 14.

In various embodiments, circuit 1200 (and therefore electronic switch 120) are supplied/driven through line 122, while drawing their power from both traveler contacts 18 and 20 through elements 124 and 126.

This makes use of the fact that, in the presently described solution, whatever the position of switch 10 may be, one of contacts 18 and 20 is in any case connected to line 16, and therefore to mains supply N.

In other words, in various embodiments:

- switch 120 can be an electronic switch, having a respective power line 122 (e.g. because, as in the illustrated example, switch 120 is driven by line 12*a*, connected to circuit 1200 which is powered through power line 122), and
- powering elements are provided (for example two diodes 124, 126) which connect above-mentioned respective power line 122 to that contact 18, 20, which is currently connected to input power supply N.

The opposed connection of both diodes 124 and 126 (the cathodes being mutually connected and the anodes being connected to one or to the other of contacts 18 and 20) preserves the necessary isolation of traveler contacts 18, 20, while at the same time enabling electronic switch 120 (and/or circuit 1200) to draw power supply N whatever the position of switch 10 (and of switch 120) may be.

Diodes 124 and 126 are therefore electrical powering elements, wherein it is possible to distinguish between:

- a first powering element (for example diode 124) Interposed between power line 122 and contact 18, i.e. one of traveler contacts 18, 20; and
- a second powering element (for example diode 126) interposed between power line 122 and contact 20, i.e. the other of traveler contacts 18, 20.

Said first and second powering elements are therefore alternatively activatable, depending on which traveler contact (contact 18 or contact 20) is currently connected to input power supply N.

In the presently considered example, said powering elements 124, 126 comprise two diodes which are connected at the cathodes thereof to power line 122, the anodes being respectively connected with one and the other of said traveler contacts 18 and 20.

In various embodiments, one or both elements 124, 126 can be implemented in different ways, for example in the form of an electronic switch (such as an SCR or a mosfet) driven by circuit 1200 through a respective driving line (shown in a dashed line in FIG. 2) so that circuit 1200 drives switch 124 or 126:

- to the closed position (ON) when the corresponding contact 18 or 20 is connected to the input power supply,
- to the open condition (OFF) when the corresponding contact 18 or 20 is not connected to power supply N.

In embodiments wherein both elements 124, 126 are comprised of an electronic switch, circuit 1200 will therefore drive:

switch 124, or respectively 126, to the closed position (ON), on the basis of which corresponding contact 18 or respectively 20 whereof is connected to the input power supply, and the other switch 126 or respectively 124 to the open position (OFF), on the basis of which corresponding contact 20 or respectively 18 is not connected to power supply N.

In various embodiments, circuit 1200 is a "smart" circuit, which can therefore contain (also for signalling to the outside, according to the operating modes of domotic systems) information concerning the activation/deactivation of load L and/or the position of switches 10 and 120, obtained for instance through sensors, by sensing the state of operating element 120*b*, or else by storing the sequence of activation/deactivation of load L. By operating according to criteria known in themselves, that do not therefore require a detailed description herein, circuit 1200 is therefore adapted to know which one of contacts 18 and 20 is currently connected to power supply N.

Moreover, one or both elements 124 and 126 can be implemented in the form of a diode (half-)bridge.

In the shown example, electronic switch 120 is coupled to electronic circuit 1200, which is supplied through power line 122 as well. In the illustrated example, electronic switch 120 is driven by electronic circuit 1200 through line 120*a*.

It will be moreover appreciated that load L can be selectively activated and deactivated through each or both switches 10 and 120, while ensuring at the same time that, even though electronic switch 120, or its associated elements, should stop operating, the ability of activating and deactivating load L through mechanical switch 10 is in any case maintained.

In various embodiments, the set of parts shown in FIG. 2 can comprise, beside the elements specifically described in the foregoing, further elements as well, such as:

one or several protection fuses F;

one or more protection resistors R1, R2, for example of the VDR (Voltage Driven Resistor) kind;

a filtering network C1, L, C2, adapted to act, according to known criteria, upon line 122 in order to draw a stabilized (pseudo-)steady voltage, to be supplied to circuit 1200.

The presence of such elements is of course optional: for example, VDR resistors can be omitted if powering elements 124 and 126 are implemented as controlled switches (SCR or mosfets, for example).

In various embodiments, the set of parts shown in FIG. 2, with the possible exception of switch 10 (normally consisting of a separate element), may form a single embedded module, in the same way as the elements enclosed in the chain-dotted line of FIG. 1.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A switch assembly for arrangement wherein a load is powered via multiple activation points, comprising:

a pair of traveler contacts alternatively connectable to a power supply, a switch having an output contact alternately connected, according to the position of the switch, to the one or the other of said traveler contacts, respectively, wherein said switch is an electronic switch with a respective supply line, and electrical powering elements are provided to connect said respective supply line to the one of said traveler contacts which is currently connected to said power supply.

2. The switch assembly of claim 1, wherein said electrical powering elements include:

a first powering element interposed between said respective power line and the one of said contacts of said pair, and a second powering element interposed between said respective power line and the other of said contacts of said pair, said first and second powering elements being alternatively activatable depending on which one traveler contact of said pair is connected to said power supply.

3. The switch assembly of claim 1, wherein said powering elements include diodes, in single-diode or bridge configuration.

4. The switch assembly of claim 1, wherein said powering elements include two diodes connected with their cathodes to said respective supply line and their anodes connected to the one and the other of said traveler contacts, respectively.

5. The switch assembly of claim 1, wherein said powering elements include at least one controlled electronic switch.

6. The switch assembly of claim 5, wherein said at least one controlled electronic switch is an SCR or MOSFET.

7. The switch assembly of claim 1, wherein said electronic switch is coupled to an electronic processing circuit which is powered through said respective power line.

8. The switch assembly of claim 7, wherein said electronic switch is driven through said electronic processing circuit.

9. The switch assembly of claim 5, wherein said at least one controlled electronic switch is controlled via said electronic processing circuit.

* * * * *